United States Patent [19]

Allen

[11] Patent Number: 4,669,125

[45] Date of Patent: Jun. 2, 1987

[54] POCKET ENCLOSURE FOR RECOIL PAD

[76] Inventor: Robert E. Allen, 3105 Stanton, Des Moines, Iowa 50321

[21] Appl. No.: 838,162

[22] Filed: Mar. 10, 1986

[51] Int. Cl.[4] ..... A41D 13/00

[52] U.S. Cl. ..... 2/2; 2/94; 2/252

[58] Field of Search ..... 2/2, 94, 250, 251, 252

[56] References Cited

U.S. PATENT DOCUMENTS

| | | | |
|---|---|---|---|
| 2,948,899 | 8/1960 | Allen | 2/94 |
| 3,257,666 | 6/1966 | Hoffman | 2/2 |
| 3,782,614 | 1/1974 | Campisi | 2/252 X |
| 4,455,684 | 6/1984 | Johnson | 2/2 |
| 4,493,115 | 1/1985 | Maier et al. | 2/2 |

FOREIGN PATENT DOCUMENTS

| | | | |
|---|---|---|---|
| 0784393 | 10/1957 | United Kingdom | 2/251 |

*Primary Examiner*—Louis K. Rimrodt
*Attorney, Agent, or Firm*—Henderson & Sturm

[57] ABSTRACT

The invention relates to a pocket enclosure for removably holding a resilient recoil pad for attachment to a shoulder portion of a shooting garment, the pocket enclosure comprising a plurality of panels forming a space for removably receiving the recoil pad, and where one of the panels includes an extended flap portion foldable over the recoil pad and into contacting relation with another of said panels, whereby the recoil pad is firmly held against movement within the enclosure.

2 Claims, 8 Drawing Figures

POCKET ENCLOSURE FOR RECOIL PAD

TECHNICAL FIELD

This invention relates to a shooting garment and particularly to a pocket enclosure attached to the garment for securely holding therein a gun butt recoil pad.

BACKGROUND ART

Hunters utilizing shoulder held guns require shoulder pads or the like to aid in absorbing the recoil energy which the gun normally transmits to the shoulder. The prior art discloses numerous types of resilient elements secured or sewn to the shoulder portions of a shooting garment.

Of further importance is the securement of the resilient element or pad to the garment such that it does not move, for even a slight movement of the pad can affect the shooting accuracy of the shooter. Such movement can also cause the shooter discomfort, resulting in physical fatigue and resulting diminishing of accuracy.

Certain general techniques and one improvement in this field shown in my previously issued U.S. Pat. No. 2,948,899. The recoil absorbing pad is inserted into a pocket in combination with a resilient member which tends to hold the pad in a wrinkle free set. Experience has shown, nevertheless that the pad still has the capability of moving within the pocket.

Those concerned with this type of problem recognize the need for an improved pocket structure for securely holding a resilient gun butt pad against the shoulder and against movement.

DISCLOSURE OF THE INVENTION

The present invention relates generally to a shooting garment and particularly to a pocket enclosure device attached to the shoulder area of the garment for securely holding a recoil absorbing pad within the device. At all times, a flap is included as a pocket element for completely enclosing the pad.

An object of the present invention is the provision of an improved shooting garment for wear by persons using shoulder-held guns.

Another object of this invention is to provide an improved pocket enclosure for securely holding a removable gun butt pad against movement.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
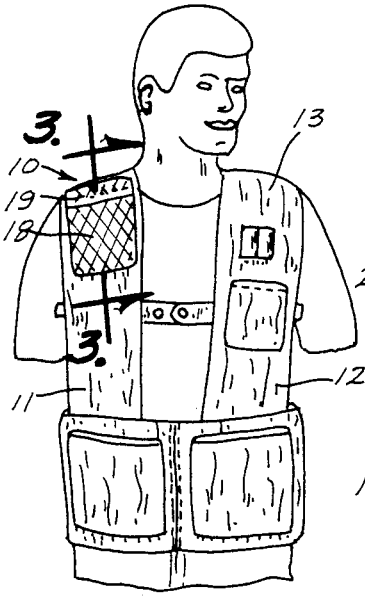
FIG. 1 is a front elevational view of a shooting garment embodying the recoil pad pocket enclosure of this invention.

Referring now to the drawings, wherein like reference numerals designate identical or corresponding parts throughout the several views, FIG. 1 shows the pocket enclosure of this invention indicated generally at (10). The pocket enclosure (10) is secured to the shoulder area of one of the front portions (11) and (12) of a shooting garment (13). The pocket enclosure (10) includes a rear rectangular panel (14) secured as by stitching (15) to the front portion (11), for example; rectangular side panels (16) and (17); a rectangular front panel (18), and a rectangular top flap (19) of the same width of the rear panel (14), integral with and extended upwardly of the rear panel (14) as best illustrated in FIG. 2; and a rectangular bottom panel (20).

Additionally, a strip (21) of Velcro or the like fastening means is secured laterally across the outer, exposed surface (22) of the top flat (19) for engagement with a mating Velcro strip (23) secured laterally across the front, exposed surface (24) of the front panel (18). The width and depth of the space formed within the enclosure (10) is equal to these dimensions of a conventional recoil pad (26) such that when the top flap (19) is folded forwardly over the front panel (18), engagement with a mating Velcro strip (23) secured laterally across the front exposed surface (24) of the front panel (18). The width and depth of the space formed between the panels (14), (16), (17), (18) and (20) is the same as those dimensions of a recoil pad (26). With the recoil pad (26) inserted into the enclosure space, as illustrated in FIG. 3, by folding the top flap (19) forwardly over the front panel (18) whereby the upper end (27) of the recoil pad (26) is engaged by the flap (19), upon mating engagement of the strips (21) and (23), the recoil pad (26) is held securely in place against movement within the pocket enclosure (10).

The recoil pad (26) is a rectangular element composed of a visco-elastic polymer which has high shock absorbing values along with vibration reduction properties. It may be covered with a material (not shown) for ease of insertion and removal into the pocket enclosure (10). As mentioned before, the dimensions of the pad (26) are such that it completely fills the rectangular space formed by the panels (14), (16), (17) and (18); the pad has a height the same as that of the panels (14), (16), (17) and (18), and when enclosed is engaged by the inner surfaces of all panels (14), (16), (17), (18) and (20) including the top flap (19).

Figure 2:
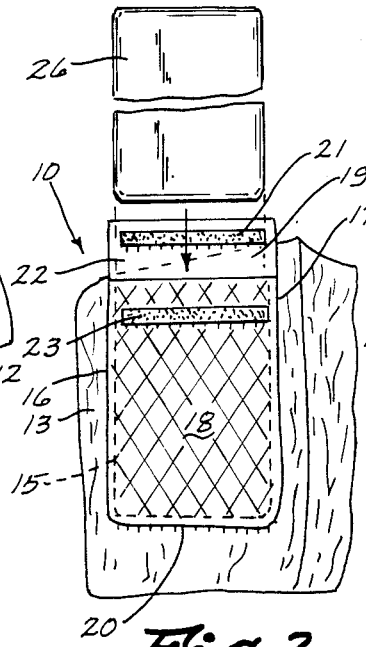
FIG. 2 is an enlarged view of the pocket enclosure of this invention showing the recoil pad removed therefrom.
Figure 3:
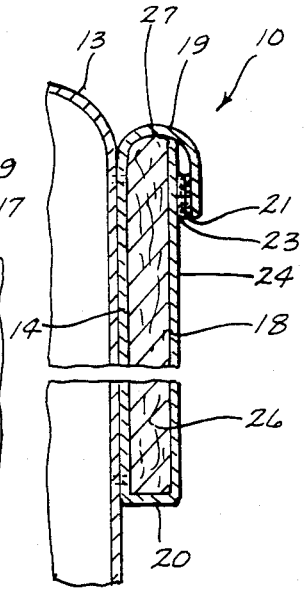
FIG. 3 is a sectional view taken along the line 3—3 in FIG. 1.
Figure 4:
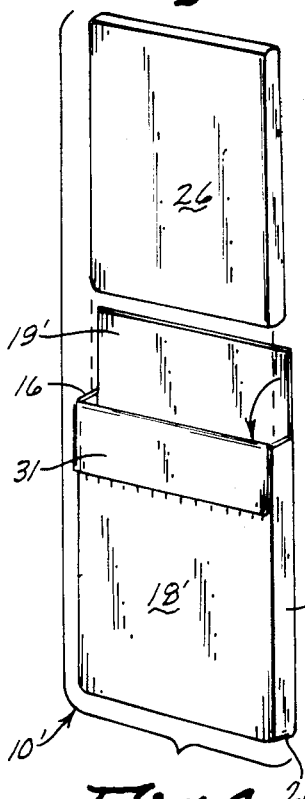
FIG. 4 is a perspective, exploded view of a second embodiment of the pocket enclosure of this invention and a recoil pad.
Figure 5:
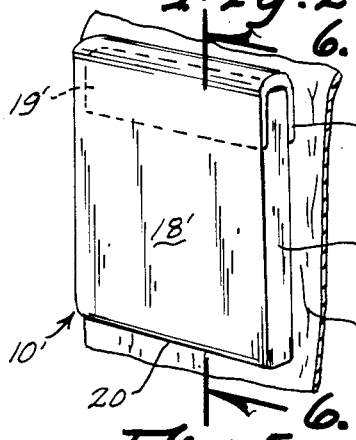
FIG. 5 is a view of the FIG. 4 embodiment showing the pad held in the pocket.
Figure 6:
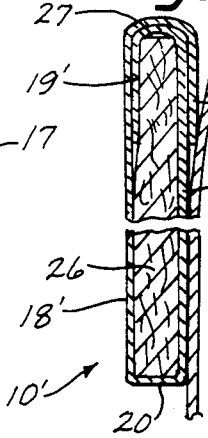
FIG. 6 is a sectional view taken along the line 6—6 in FIG. 5.

Referring to FIGS. 4–6, a second embodiment of the pocket enclosure is indicated generally at (10′) with like parts to the first embodiment in FIGS. 1–3 indicated by like reference numerals. Integral with the front panel (18′) and extended higher than the height of the side panels (16), (17) is a rectangular front flap (31) shown folded forwardly at down in FIG. 4. It will be noted the front panel (10′) and the rear panel top flap (19′) do not have Velcro fastening strips (21) and (23) attached thereto. When the recoil pad (10′) is inserted into the space of the pocket enclosure (10′), being engaged by the inner surfaces of panels (14), (16), (17), (18') and (20'), the top flap (19) is folded forwardly over in engaging relation with the top (27) of the recoil pad (26) and is then tucked downwardly in between the pad (26) and the front panel (18'). To complete the enclosure, the font flap (31) is then folded rearwardly over the top flap (19) and tucked downwardly between the rear panel (14) and the shooting garment (13) (FIG. 6). It should be further noted that at least in this instance there would be no stitching of the rear panel (14) across its upper end to the garment (13) to prevent the front flap (31) from being tucked therebetween.

Figure 7:
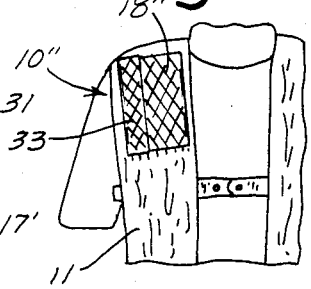
FIG. 7 is a front elevational view of a third embodiment of this invention.
Figure 8:
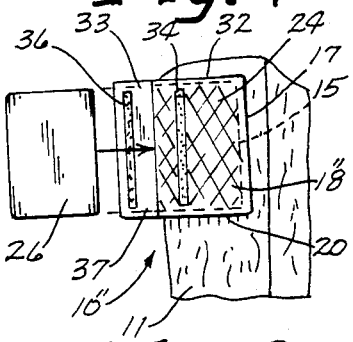
FIG. 8 is a view similar to FIG. 7 with the side flap of the pocket enclosure open for insertion of a recoil pad.

A third embodiment of the pocket enclosure is indicated at (10'') in FIGS. 7 and 8, again with like parts indicated by like reference numerals as to the first embodiment of FIGS. 1–3. The upper end of the enclosure (10'') is covered by a top panel (32) having the same dimensions as the bottom panel (20), but one side panel (16) is removed and replaced with a wider rectangular side flap (33). Velcro mating fasteners (34) and (36) are secured vertically down one side of the front panel outer surface (24) and down the inner surface (37) of the side flap (33), respectively, as best shown in FIG. 8.

When the recoil pad (26) is removably inserted into the pocket enclosure (10'') from the side, upon folding the side flap (33) forwardly and over the front panel (18'') and locking the fasteners (34) and (36), the recoil pad (26) is held tightly engaged by all panels (14), (17), (18''), (20), (32) and the side flap (33). By this arrangement, the recoil pad is held against movement on the shooting garment (13), thereby achieving the objectives sought herein.

I claim:

1. A pocket enclosure for removably holding a resilient, rectangular recoil pad for attachment to a shoulder portion of a shooting garment, the improved pocket enclosure comprising:

a rear panel;

a pair of laterally spaced side panels secured to said rear panel;

a bottom panel secured to said rear and side panels;

a front panel secured to said bottom and side panels and spaced forwardly of said rear panel;

a planar top panel integral with and having a width equal that of said rear panel; and said rear, side, bottom, front and top panels forming a space for removably receiving the recoil pad therein whereby the recoil pad is firmly held against movement within the enclosure;

further wherein all of said panels and said flap are in engagement with the recoil pad;

further wherein interlocking fastening strips are secured substantially completely across the exposed surfaces of said front panel and top panel extension, whereby when the recoil pad is inserted within the enclosure, said top panel extension is foldable over the recoil pad and fastenably engageable with the front panel.

2. The invention of claim 1 and further wherein said front panel includes a front flap extension, said top panel foldable over the recoil pad when inserted within the pocket enclosure and tuckable between the recoil pad and said front panel, with said front flap extension foldable over the tucked top panel and into contacting engagement with said rear panel and adapted to engage the shoulder portion of the shooting garment.

* * * * *